US006758001B1

(12) United States Patent
Su

(10) Patent No.: US 6,758,001 B1
(45) Date of Patent: Jul. 6, 2004

(54) VIVID CHRISTMAS DEER TOY

(76) Inventor: Lien Cheng Su, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/336,681

(22) Filed: Jan. 6, 2003

(51) Int. Cl.[7] ..... G09F 1/08

(52) U.S. Cl. ..... 40/538; 40/540; 40/414; 428/7; 446/353

(58) Field of Search ..... 40/414, 427, 429, 40/538, 540; 428/7; 446/352, 353, 354, 376

(56) References Cited

U.S. PATENT DOCUMENTS 4,867,730 A * 9/1989 Lee ..... 446/353
5,850,927 A * 12/1998 Pan ..... 211/181.1
6,394,282 B1 * 5/2002 Pan ..... 211/1.51
6,413,594 B1 * 7/2002 Onishi ..... 428/7
6,478,164 B1 * 11/2002 Pan ..... 211/1.51

* cited by examiner

*Primary Examiner*—Brian K. Green

(57) ABSTRACT

A Christmas deer toy is capable of moving the head, neck, and tail thereof. The body unit, head unit, neck unit, and tail unit are pivotally connected. By a driving unit, the parts can move vividly to simulate the action of an animal. The driving unit includes a motor, a rotary arm, a main driving arm, a tail driven arm, and a neck driven arm. Only a few components are used and the structure is simple. A rear end of the head unit has an extending arm and a weight for assisting the actions of the head unit to be more vivid. Moreover, by arranging electric wires and bulbs, the vivid Christmas deer toy can be as a beautiful artistic production.

1 Claim, 5 Drawing Sheets

VIVID CHRISTMAS DEER TOY

FIELD OF THE INVENTION

The present invention relates to movable decorations, and particularly to a vivid Christmas deer toy.

BACKGROUND OF THE INVENTION

Deer is used as a symbol of luckiness, and thus they are especially used in Christmas as a decoration. In prior arts, deer decorations are static. Afterwards, deer decorations are added with function of movement, but in general, the movement of the deer is dull. Only a part of the deer decoration is movable, even the motion is simple. Thereby, the action of the deer is mechanical and is not like a practical animal.

Some movable deer are improved to present more vivid actions but the structure is very complicated and thus many components are used so that costs in parts and labors are high.

SUMMARY OF THE INVENTION

Accordingly, the primary object of the present invention is to provide a vivid Christmas deer toy, wherein the body unit, head unit, neck unit, and tail unit are pivotally connected. By a driving unit, the parts can move vividly to simulate the action of an animal.

Another object of the present invention is to provide a vivid Christmas deer toy, wherein the driving unit includes a motor, a rotary arm, a main driving arm, a tail driven arm, and a neck driven arm. Only a few components are used and the structure is simple.

A further object of the present invention is to provide a vivid Christmas deer toy, wherein a rear end of the neck unit has an extending arm and a weight for assisting the actions of the head unit and neck unit to be more vivid.

The various objects and advantages of the present invention will be more readily understood from the following detailed description when read in conjunction with the appended drawing.

DETAILED DESCRIPTION OF THE PREFERRED EMBODIMENTS

Figure 1:
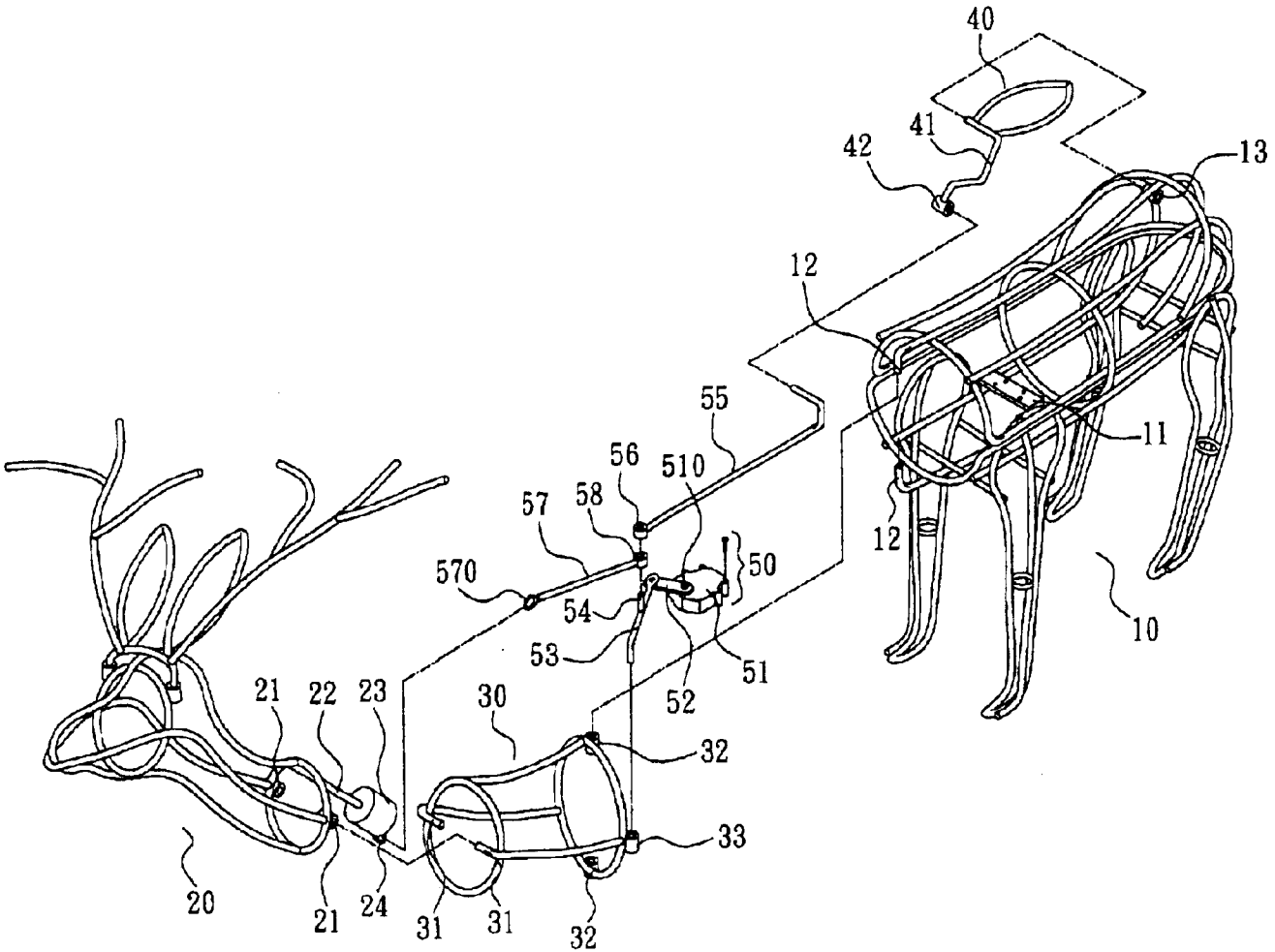
FIG. 1 is an exploded perspective view of the present invention.
Figure 2:
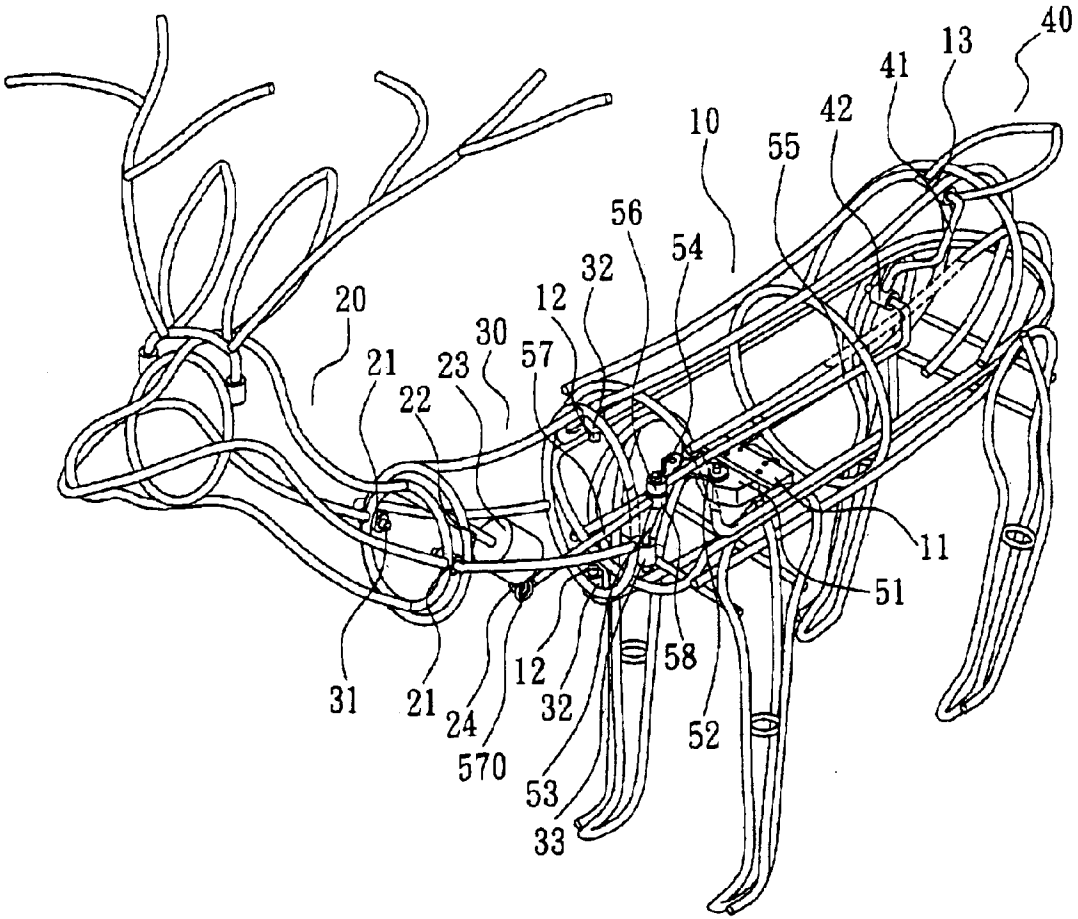
FIG. 2 is an assembled perspective view of the present invention.

Referring to FIGS. 1, 2, 3 and 4, the vivid Christmas deer toy of the present invention is illustrated. The vivid Christmas deer toy includes a body unit 10, a neck unit 30, a head unit 20 a tail unit 40, and a driving unit 50.

The body unit 10 is made by bending and welding a plurality of metal rods. A retaining seat 11 is installed therein for fixing a motor 51. Two sides of a front end of the body unit 10 are respective linkages 12 for being pivotally connected to the neck unit 30. A rear end of the body unit 10 is installed with a pivotal end 13 for being connected to the tail unit 40.

The neck unit 30 is made by bending and welding a plurality of metal rods. Two sides of a front end of the neck unit 30 are installed with linkage rods 31 for being pivotally connected to the head unit 20. A rear end of the neck unit 30 are installed with an upper and a lower pivotal elements 32 for being pivotally connected to the linkages 12 at the front end of the body unit 10. One side of the rear end of the neck unit 30 is installed with a lateral pivotal element 33.

The head unit 20 is made by bending and welding a plurality of metal rods. Two sides of a rear end of the head unit 20 are installed with lateral pivotal blocks 21 for being pivotally connected to the linkage rods 31 of the neck unit 30. A rear end of the head unit 20 is installed with an extending arm 22. A distal end of the extending arm 22 has a weight 23. A distal end of the weight 23 is installed with a connecting ring 24.

The tail unit 40 is formed by bending and welding metal rods. A front end of the tail unit 40 is a connecting rod 41 with a pivotal portion 42. A lateral side of the connecting rod 41 is pivotally connected to the pivotal end 13 of the body unit 10.

The driving unit 50 contains a motor 51, a rotary arm 52, a main driving arm 53, a tail driven arm 55, and a head driven arm 57. The motor 51 is fixed to the retaining seat 11 of the body unit 10. One end of the rotary arm 52 is fixed to a rotary shaft of the motor 51 and another end of the rotary arm 52 is pivotally connected to the main driving arm 53. A middle section of the main driving arm 53 is installed with a driven rod 54. A front end of the head driven arm 57 has a connecting hook 570 for hooking the connecting ring 24 of the weight 23 of the head unit 20 and a rear end of the head driven arm 57 is installed with a pivotal part 58 for being pivotally connected to a driven end 54 of the main driving arm 53. The main driving arm 53 is pivotally connected to the lateral pivotal element 33 of the neck unit 30 which is connected eccentrically. A front end of the tail driven arm 55 is formed with a pivotal means 56 which is pivotally connected to the driven rod 54 of the main driving arm 53 and a rear end of the tail driven arm 55 is pivotally connected to the pivotal portion 42 of the tail unit 40.

The operation of the present invention will be described herein.

When the motor 51 is operated, the rotary shaft 510 rotates to drive a rotary arm 52. Moreover, following actions will be generated.

Figure 3:
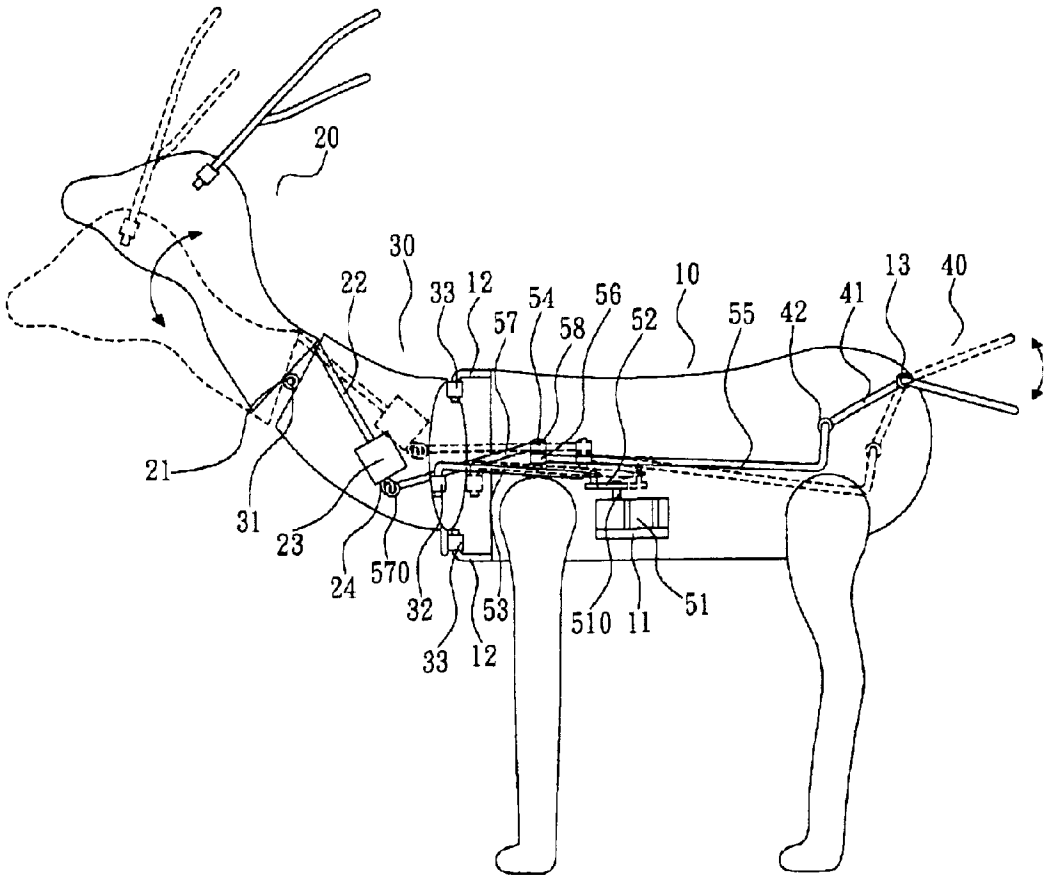
FIG. 3 is a schematic view showing one action of the present invention.

The head unit 20, and tail unit 40 can swing up and down, as shown in FIG. 3. The rotary arm 52 rotates so that the main driving arm 53 displaces to generate pull forces and push forces. By the head driven rod 54 to be pivotally connected to the head driven arm 57 and then is hooked to the connecting ring 24 of the head unit 20 so as to pull the extending arm 22 to move downwards to eject the extending arm 22 to move upwards. Thereby, the head unit 20 moves upwards or downwards to present an action of nod. Meanwhile, since the driven rod 54 of the main driving arm 53 is pivotally connected to the tail driven arm 55 and then is pivotally connected to the tail unit 40, the tail unit 40 moves downwards and upwards to present an action of swing the tail. Namely, the head unit 20 moves upwards and downwards around the pivotal connection of the lateral pivotal end 21 of the head unit 20 and the connecting rod 31 of the neck unit 30.

Figure 4:
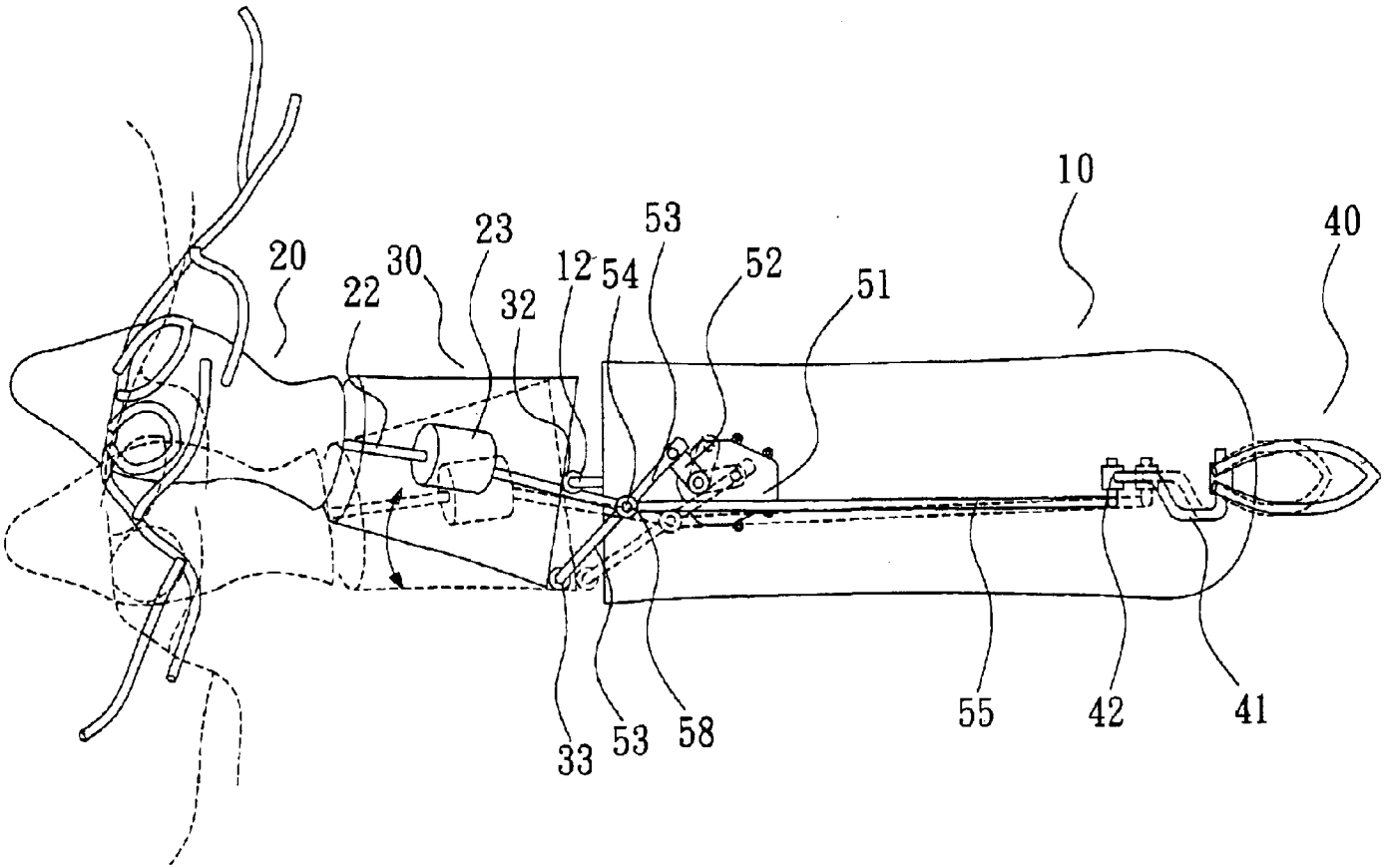
FIG. 4 is a schematic view showing another action of the present invention.

The head unit 20 and neck unit 30 can move leftwards or rightwards, as shown in FIG. 4. When the rotary arm 52 and the main driving arm 53 rotates, since the rear end of the lateral pivotal end 33 at the rear end of the neck unit 30 is pivotally connected to the main driving arm 53 eccentrically, the main driving arm 53 generates pull force and push force to pull the neck unit 30. The neck unit 30 and head unit 20 are connected as an integral body. Thereby, the neck unit 30 and head unit 20 moves leftwards and rightwards. In detail, the neck unit 30 shakes around the pivotal elements 32 to drive the head unit 20 to present an effect of shaking.

The effect of the weight 23 will be described herein. The head unit 20 is inclined upwards. A downward force will generate. The weight 23 at the distal end of the extending arm 33 is heavy so as to generate a downward force at a rear end. Thereby, seesaw effect is generated so that the head unit 20 easily moves downwards and upwards.

Figure 5:
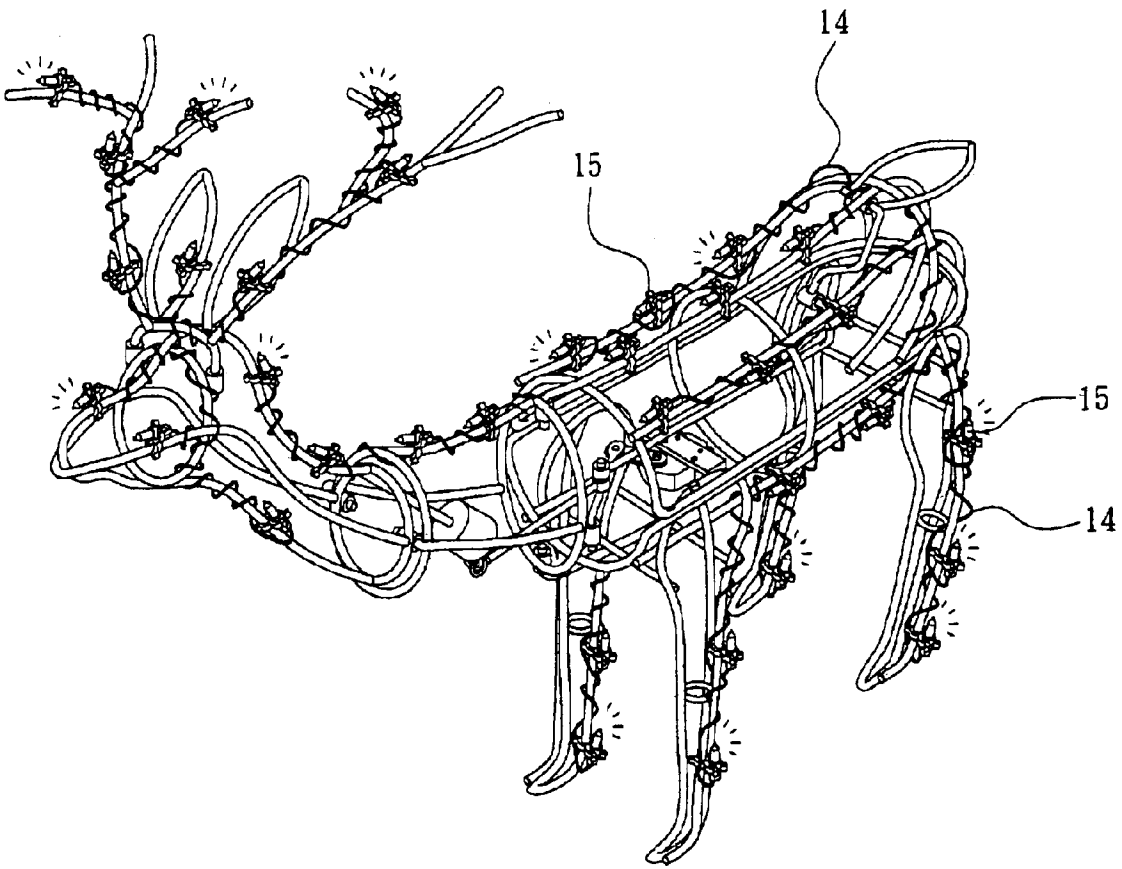
FIG. 5 is a schematic view showing that light effect is arranged in the present invention.

It is appreciated from above description that in the present invention, the motor 51 is installed with the driving unit 50. The driving unit 50 is formed by a main driving arm 53, a neck driven arm 57, and a tail driven arm 55. Thereby, the head, neck and tail can present the action of nodding head, shaking head, and shaking tail by only a free components and a simple structure so as to present a vivid shape. Moreover, as shown in FIG. 5, by arranging electric wires 14 and bulbs 15, the Vivid Christmas deer toy of the present invention can be as a beautiful artistic production.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A vivid Christmas deer toy comprising a body unit, a neck unit, a head unit, a tail unit, and a driving unit; wherein the body unit is made by bending and welding a plurality of metal rods; a retaining seat is installed therein for fixing a motor; two sides of a front end of the body unit has respective linkages for being pivotally connected to the neck unit; a rear end of the body unit is installed with a pivotal end for being connected to the tail unit;

the neck unit is made by bending and welding a plurality of metal rods; two sides of a front end of the neck unit are installed with linkage rods for being pivotally connected to the head unit; a rear end of the neck unit are installed with an upper and a lower pivotal elements for being pivotally connected to the linkages at the front end of the body unit; one side of the rear end of the neck unit is installed with a lateral pivotal element;

the head unit is made by bending and welding a plurality of metal rods; two sides of a rear end of the head unit are installed with lateral pivotal blocks for being pivotally connected to the linkage rods of the neck unit; a rear end of the head unit is installed with an extending arm; a distal end of the extending arm has a weight; a distal end of the weight is installed with a connecting ring;

the tail unit is formed by bending and welding metal rods; a front end of the tail unit is a connecting rod with a pivotal portion; a lateral side of the connecting rod is pivotally connected to the pivotal end of the body unit;

the driving unit contains a motor, a rotary arm, a main driving arm, a tail driven arm, and a head driven arm; the motor is fixed to the retaining seat of the body unit; one end of the rotary arm is fixed to a rotary shaft of the motor and another end of the rotary arm is pivotally connected to the main driving arm; a middle section of the main driving arm is installed with a driven rod; a front end of the head driven arm has a connecting hook for hooking the connecting ring of the weight of the head unit and a rear end of the head driven arm is installed with a pivotal part for being pivotally connected to a driven end of the main driving arm; the main driving arm is pivotally connected to the lateral pivotal element of the neck unit which is connected eccentrically; a front end of the tail driven arm is formed with a pivotal means which is pivotally connected to the driven rod of the main driving arm and a rear end of the tail driven arm is pivotally connected to the pivotal portion of the tail unit;

wherein by driving the motor of the driving unit, the rotary arm, main driving arm, tail driven arm, neck driven arm, and extending arm, the head unit, neck unit, and tail unit moves.

* * * * *